United States Patent [19]

Cuthbertson

[11] 4,300,608

[45] Nov. 17, 1981

[54] SELF-RAISING STRAP LOOP

[75] Inventor: Bruce Cuthbertson, Macon, Ga.

[73] Assignee: Bonar Industries Inc., Macon, Ga.

[21] Appl. No.: 147,392

[22] Filed: May 7, 1980

[51] Int. Cl.[3] ..... A45C 13/26; B65D 33/06

[52] U.S. Cl. ..... 150/12; 150/1; 229/54 R

[58] Field of Search ..... 150/1, 12, 17; 229/54 R; 139/389, 390

[56] References Cited

U.S. PATENT DOCUMENTS

| | | | |
|---|---|---|---|
| 733,542 | 7/1903 | Converse | 150/12 |
| 1,807,819 | 6/1931 | Altgelt | 150/12 |
| 3,208,492 | 9/1965 | Braithwaite | 150/12 |
| 4,010,784 | 3/1977 | Nattrass et al. | 150/1 |

FOREIGN PATENT DOCUMENTS

| | | | |
|---|---|---|---|
| 1005023 | of 0000 | Canada | 150/12 |
| 1007203 | of 0000 | Canada | 150/12 |
| 842681 | of 0000 | United Kingdom . | |
| 916585 | of 0000 | United Kingdom . | |
| 945199 | of 0000 | United Kingdom . | |
| 1000079 | of 0000 | United Kingdom . | |
| 1556818 | of 0000 | United Kingdom . | |

*Primary Examiner*—George T. Hall

*Attorney, Agent, or Firm*—Roylance, Abrams, Berdo & Farley

[57] ABSTRACT

A self-raising strap loop is described, for use with a flexible, stackable container. The strap loop includes a strap which is flexible, and resilient means associated with the strap so that when the container is subjected to stacking forces the strap loop will lie substantially flat on the container, but when the stacking forces are removed, the loop will be forced to assume an upstanding position ready to receive a lifting device such as a fork of a fork-lift truck. The resilient means may be a resilient plastics or metallic insert enveloped by the strap, either in the form of a flat strip or a plurality of wires. The resilient means may also take the form of plastics or metallic wires woven into or being the warp threads of a woven strap. The resilient means may also be an impregnating material within a woven strap to render it semi-rigid. By using the self-raising strap loop it becomes unnecessary to pre-orient a lifting strap prior to engagement with a suitable lifting device.

38 Claims, 9 Drawing Figures

SELF-RAISING STRAP LOOP

BACKGROUND OF THE INVENTION

Canadian Pat. Nos. 1,005,023 (Feb. 9, 1978) and 1,007,203 (Mar. 22, 1977), both issued to Frank and Peter Nattrass illustrate bulk material containers adapted to carry several cubic feet of material, especially powdered or granular material. Such containers take the form of flexible bags having top and bottom walls having a filling and a dispensing spout respectively. Additionally, the bags are provided with lifting straps or handles affixed to the corners of the bags, adjacent the top wall thereof. Such straps may be formed of woven terylene or polyester and they are stitched to the bag so as to form lifting loops which can cooperate with the forks of a fork-lift truck when it becomes necessary to transport a full bag. Furthermore it is not uncommon to stack filled containers for storage purposes and, in order to avoid complications when stacking, the lifting straps are sufficiently flexible that their normal position of repose is flat on top of the filled container. The flexibility of the straps becomes a detriment however when the bag is to be transported, as it becomes necessary for an operator to manually lift the straps in order to orient them properly to accept the forks of the fork-lift truck. Thus, when transporting containers, two men are required, one to operate the truck, and one to orient the lifting straps.

SUMMARY OF THE INVENTION

The present invention overcomes the problems associated with such prior art configurations by providing a self-raising strap loop for such containers. The strap loop of the present invention has, in addition to the normal strap, a resilient member which forces the loop to assume an upstanding position whereby when upstanding it is always ready to accept the lifting means, such as the forks of a fork-lift truck. When the container is subjected to stacking forces, as by having another container stacked thereon, the strap loop of the present invention is sufficiently flexible that the stacking forces will cause it to lie substantially flat on its container. However, when the stacking forces are removed, the resilient member again forces the strap loop to assume its upstanding posture, ready to receive the lifting means. It is readily seen that by using such a self-raising strap loop it is no longer necessary to have a second operator to orient the straps preparatory to receiving the lifting means.

The self-raising strap loop of the present invention may take several forms. It may involve a flat elongated strip of resilient plastics or metallic material enclosed within a pair of flexible straps or a tubular sleeve. It may involve a woven strap wherein the warp threads are resilient plastics or metallic wires. Also it may involve impregnating a flexible strap with a plastics material to produce a resilient or semi-rigid strap having the desired properties.

In summary of the above the present invention broadly contemplates a self-raising strap loop for a stackable, flexible container subjectable to lifting forces, comprising a flexible strap member connectable at each end thereof to the container, with a bight portion defined between the ends, and resilient means associated with the bight portion over a substantial portion of the length thereof, whereby when connected to a container and subjected to stacking forces the resilient means will permit the loop to flex so as to lie substantially flat on the container and, when such stacking forces are released, the resilient means will cause the loop to raise to an upstanding position to accept a lifting member therein.

Furthermore the present invention may be seen to provide in a flexible stackable container capable of being lifting by mechanical means and defined by at least an encircling side wall portion and a bottom wall portion, the improvement comprising at least one self-raising strap loop connected to said container, said strap loop comprising a flexible strap member having end portions and a bight portion between said end portions, said end portions being secured to said container side wall portion, and resilient means associated with said bight portion over a substantial portion of the length thereof, whereby when said container is subjected to stacking forces the resilient means will flex to permit the strap loop to lie substantially flat on said container and, when such stacking forces are released, the resilient means will raise the loop to a position to accept the mechanical lifting means.

DESCRIPTION OF THE PREFERRED EMBODIMENT

Figure 1:
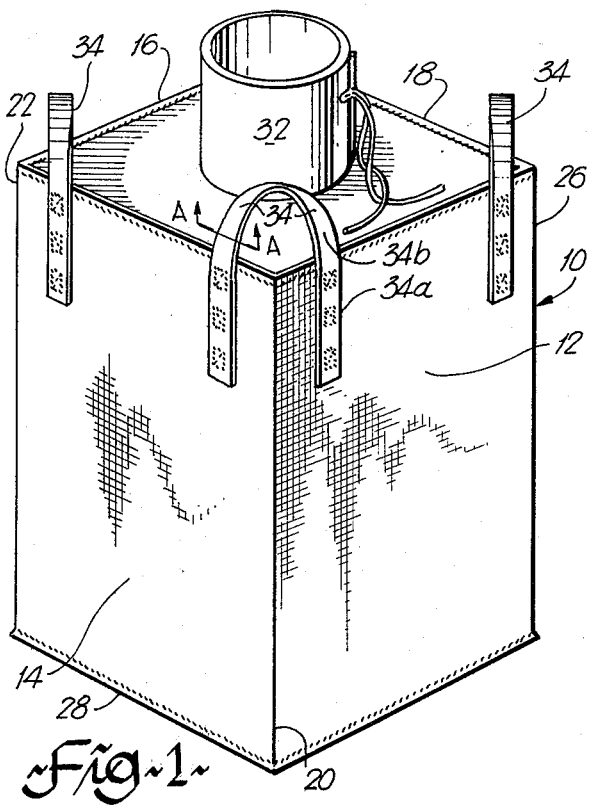
FIG. 1 is a perspective view of a flexible, stackable container incorporating self-raising strap loops of the present invention.

FIG. 1 shows a flexible stackable container of the type which benefits from a self-raising strap loop according to the present invention, the container being designated by reference number 10. The container has an encircling wall portion defined by four side walls 12, 14, 16, 18, each pair of side walls defining corresponding corners 20, 22, 24, 26 (corner 24 not being visible). The container also has a bottom wall portion 28 and it may have, optionally a top wall portion 30. In the container of FIG. 1 the top wall has a closable filling spout 32. Typically the walls of the container may be woven from a high-strength polypropylene material and may take the general form as shown in Canadian Pat. No. 1,007,203.

Arranged at each corner of the container is a self-raising strap loop 34, each loop being elongated with each end portion 34*a* of each loop being connected, as by stitching, to corresponding side walls of the container forming the corner and thereby forming a bight portion 34*b*. Thus as seen in FIG. 1 the loop 34 at corner 20 has one end 34*a* stitched to side wall 12 and the other end 34*a* thereof stitched to side wall 14. The stitching configuration and the material of the loop is selected so that when the container is subjected to lifting forces through the bight portions 34*b* of the loops there will be sufficient safety factor so as to avoid any failure either of the loop itself or of the connection between the loop and the container. The material for the loops could be a woven terylene, polyester or nylon as used in vehicle seat belts.

The self-raising strap loop of the present invention has distinct advantages over previous flexible loops such as those illustrated in the aforementioned Canadian Pat. No. 1,007,203. In that patent the loops lie flat on top of the container and if the container is to be lifted by mechanical means, as by a fork-lift truck, it is necessary for an operator to first lift and arrange the loops to position them for acceptance of the forks of the fork-lift truck. This problem is overcome with the self-raising strap loops of the present invention.

Figure 2:
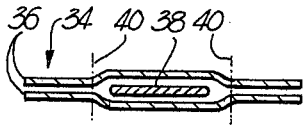
FIG. 2 shows one embodiment of the strap loop of the present invention taken along the section line A—A of FIG. 1.

FIG. 2 shows in cross-section a first embodiment of a self-raising strap loop as contemplated herein. As seen in FIG. 2 a pair of elongated straps 36 are positioned in abutting face-to-face juxtaposition. The straps 36 envelop an insert 38 which extends along substantially the entire length of the bight portion of the loop. The straps 36 are secured together along and adjacent to the longitudinal edges of the insert to completely envelop the insert, as by stitching 40. While not shown it is clear that one strap 36 could be wider than the other, the narrower strap being sufficiently wide to cover the insert and still be secured to the wider strap.

The insert 38 is formed from a resilient material and may be in flat strip or wire form, a flat strip being shown. Excellent results have been obtained with strips formed of nylon, high density polyethylene, stainless or spring steel or fibre glass. In operation, with the container as shown in FIG. 1 the resilient insert flexes sufficiently to force each loop into an upstanding position so as to accept appropriate lifting means, such as the forks of a fork-lift truck. When the container is subjected to stacking forces, as by having another container placed thereon, the resilient insert will flex under such forces sufficiently so that the loop will lie substantially flat on top of the lower container. When the stacking forces are removed the resilient insert forces the loop to resume its upstanding position, ready to receive the appropriate lifting means. Clearly this is an improvement over prior art strap arrangements as the necessity of a manual orientation step for the straps has been eliminated.

Figure 3:
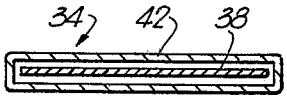
FIG. 3 shows a second embodiment of the strap loop of the present invention taken along the section line A—A of FIG. 1.
Figure 4:
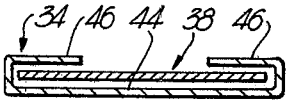
FIG. 4 shows a third embodiment of the strap loop of the present invention taken along the section line A—A of FIG. 1.
Figure 5:
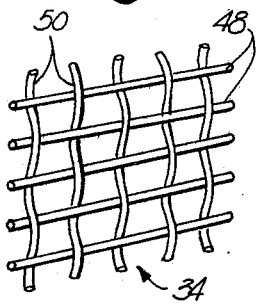
FIG. 5 shows a partial perspective view on a large scale of a fourth embodiment of a strap loop according to the present invention.

FIGS. 3, 4 and 5 illustrate several alternative embodiments for the self-raising strap loop of the present invention, each of which would be connected to the container and operate in the same manner as the strap loop of FIG. 2. In FIG. 3, for example the strap loop 34 takes the form of a tubular sleeve 42 formed into a generally rectangular configuration and receiving therein an insert 38 along substantially the entire length of the bight portion. As with the first embodiment the insert may be formed as a plurality of wires or as a flat strip, extending over substantially the entire length of the strap loop 34. The sleeve itself may be woven terylene, as suggested hereinabove, or it may be extruded from a suitable material such as high density polyethylene, nylon or fibre glass.

FIG. 4 shows an embodiment wherein the strap loop 34 is formed as a C-shaped strap having a base portion 44 and pair of re-entrant flange portions 46. In this embodiment the insert 40 is affixed to the base portion 44 in any suitable manner along substantially the entire length of the bight portion, as by adhesive bonding, and the flange portions 46 are moved so as to cover at least a part of the insert. The flange portions 46 may also be adhesively bonded to the insert 40. In this embodiment it would be preferable to utilize an insert formed from a resilient flat strip material rather than one formed of a plurality of wires since, contrary to the first two embodiments, the insert is not completely contained within the strap loop 34.

FIG. 5 illustrates a woven strap loop 34 wherein the resilient member is formed as an integral part of the strap itself. In this embodiment the warp portion of the strap is formed of resilient wires 48 made from stainless or spring steel while the weft threads or portions 50 are made from terylene or any other material which might otherwise be used to form a woven strap.

Figure 6:
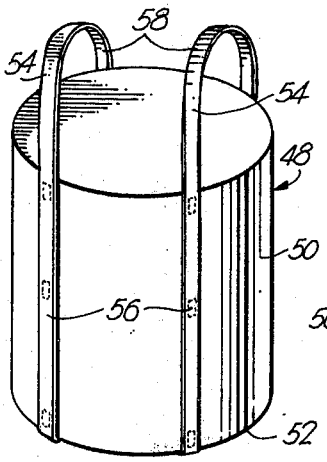
FIG. 6 shows a generally circular container having two strap loops according to the present invention secured thereto.
Figure 7:
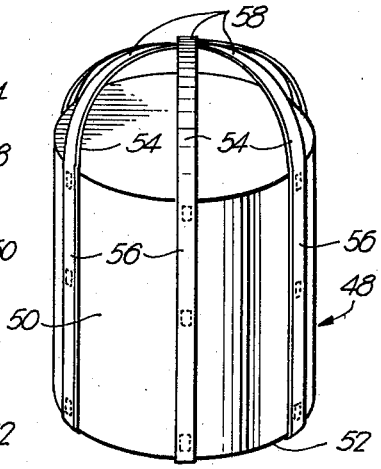
FIG. 7 shows a generally circular container having three strap loops according to the present invention secured thereto.

FIGS. 6 and 7 show different strap loop arrangements for containers which may be generally circular in cross-section rather than rectangular. In FIG. 6 the container 48 has an encircling side wall portion 50 and a bottom wall portion 52. Two flexible strap loops 54 are provided, the strap loops being spaced apart and being parallel to each other. The leg portions 56 extend along the full height of the container side wall portion and are secured thereto as by stitching. In this embodiment the bight portions 58 would cross the container and would be considerably larger than the bight portions 34*b* of the strap loops 34 used in the FIG. 1 container. Any of the previously described strap loops of the present invention could be used with this embodiment.

In FIG. 7 three flexible strap loops 54 are provided, the strap loops being equiangularly space about the container side wall portion 50 so that the leg portions 56 are diametrically opposed and the bight portions 58 cross at the center of the container. As with the FIG. 6 embodiment any of the previously described strap loops of the present invention could be utilized.

While not specifically shown it would be possible to utilize only a single strap loop 54 secured to the container with the leg portions 58 being on the same diameter. This configuration could be used when the load carried by the container is relatively light as it would be necessary to ensure that there is sufficient strength in the strap loop and the connection to the container to avoid failure or damage. This of course would be the most basic container configuration utilizing the strap loop of the present invention.

Figure 8:
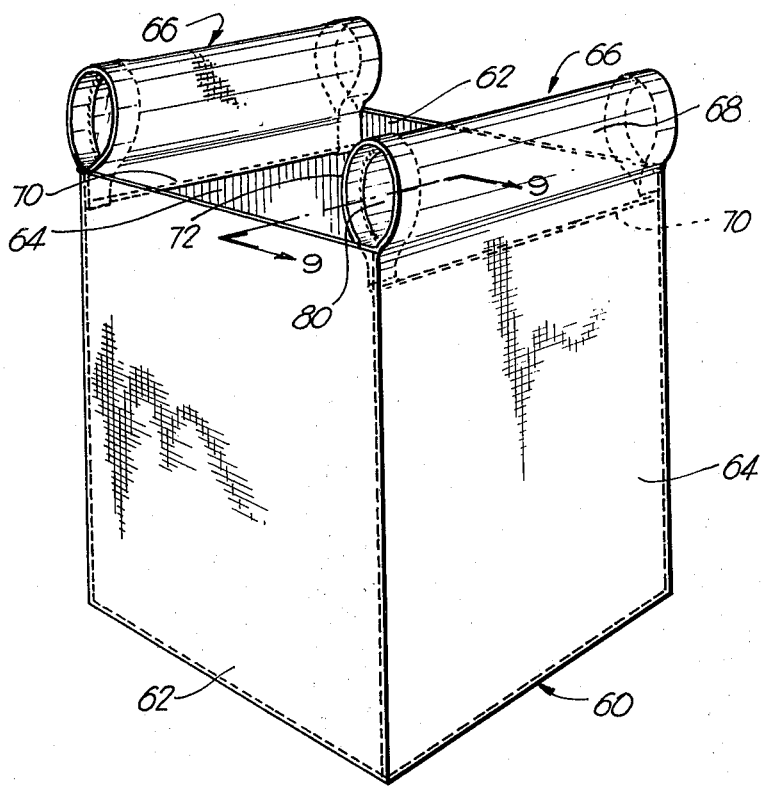
FIG. 8 shows a perspective view of another container configuration utilizing elongated strap loops formed as integral parts of the side walls of the container.

FIG. 8 shows a further embodiment of the present invention wherein an elongated sleeve type of strap loop is utilized. This aspect of the present invention is particularly applicable to a generally rectangular container 60 having pairs of opposed wall portions 62, 64. A pair of elongated strap loops or sleeves 66 are provided, extending along each of the opposed side wall portions 64 adjacent the upper margin of the container. In this embodiment each loop comprises an extension 68 of the corresponding wall portion 64, which extension is looped back and is connected to the wall portion along the connection line 70, as by stitching. In this way the bight portion 72 is formed. As illustrated the free end of the extension 68 is connected to the side wall portion inside the container although it could equally be connected to the corresponding side wall portion on the exterior surface thereof.

Figure 9:
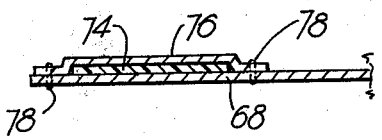
FIG. 9 shows a cross-section of one end of the strap loop used in the embodiment of FIG. 8, taken along the line 9—9 thereof.

Adjacent each end of each sleeve or loop 66 is positioned a resilient insert similar to any of the inserts previously described. FIG. 9 illustrates one manner in which the insert, which extends substantially over the entire length of the bight portion of the loop, may be secured to the loop. As seen in FIG. 9 the insert 74 rests on the material of the side wall portion 64 and of the extension 68 over the length of the bight portion and a covering strip 76 of a flexible material is laid over the insert and stitched to the underlying material as by stitching 78. Clearly strap loops such as illustrated with regard to FIGS. 2, 3 or 4 could also be secured to each sleeve to achieve the same end result.

In operation, the inserts 74 positioned as they are at each corner of the container force the two sleeves or loops 66 to a generally upstanding position as shown in FIG. 8 when there are no stacking forces applied to the container. The material of each sleeve may not be taut between the inserts thereof but in the vicinity of each insert a clear opening 80 will be ensured through which a fork or other lifting means may pass for reception in the sleeve. Lifting forces may then be applied to the container via the sleeves. When subjected to stacking forces the sleeves will collapse and when such forces are removed the sleeves will again assume an upright, open stance, ready to receive a lifting mechanism.

When manufacturing a container such as is illustrated in FIG. 8 the sleeves or strap loops 66 would be constructed on the side walls 64 before such walls are connected to the walls 62 and the bottom wall to form the container. A top wall may be added if desired, as seen in the embodiment of FIG. 1.

It is apparent that further embodiments of the present invention could occur to people skilled in the art. For example, modified versions of the preceding embodiments could delete the flange portions 46 of FIG. 4 or could attach a strap loop of FIG. 3 to an existing single woven strap, so as to achieve the benefit of the present invention. It would also be possible to impregnate a woven strap with a plastics material so as to render a very flexible strap more rigid and thereby impart to the strap the same properties imparted thereto by use of the previously-described resilient insert. Accordingly the scope of protection to be afforded the present invention is to be determined by the claims appended hereto.

The embodiments of the invention in which an exclusive property of privilege is claimed are defined as follows:

1. A self-raising strap loop for a stackable, flexible container subjectable to lifting forces, comprising a flexible strap member connectable at each end thereof to said container, with a bight portion defined between the ends and resilient means associated with said bight portion over a substantial portion of the length thereof, whereby when connected to a container and subjected to stacking forces said resilient means will permit said loop to flex so as to lie substantially flat on said container and, when such stacking forces are released, said resilient means will cause said loop to raise to an upstanding position to accept a lifting member therein.

2. The strap loop of claim 1 wherein said strap member comprises a pair of elongated flexible straps positioned in abutting face-to-face juxtaposition and said resilient means comprises an elongated resilient insert positioned between said straps, said straps being secured together adjacent the longitudinal edges of said insert in order to enclose said insert by said straps.

3. The strap loop of claim 1 wherein said strap member comprises an elongated tubular sleeve and said resilient means comprises an elongated resilient insert positioned within said tubular sleeve.

4. The strap loop of claim 1 wherein said strap member comprises an elongated strap having a generally C-shaped cross-section with a base portion and a pair of re-entrant flange portions, said resilient means comprises an elongated resilient insert affixed to said base portion and covered at least in part by said re-entrant flange portions.

5. The strap loop of claim 2, 3 or 4 wherein said insert is generally flat over its length and is formed of a resilient plastics material.

6. The strap loop of claim 2, 3 or 4 wherein said insert is generally flat over its length and is formed of a resilient metallic material.

7. The strap loop of claim 2, 3 or 4 wherein said insert is in the form of a plurality of resilient metallic wires.

8. The strap loop of claim 1 wherein said strap member is woven with warp and weft portions, said resilient means comprising the warp portions of said strap member.

9. The strap loop of claim 8 wherein said warp portions are formed of resilient metallic wires.

10. The strap loop of claim 1 wherein said strap member is woven with warp and weft portions and said resilient means comprises a plastics material impregnated within the woven strap to render the strap semi-rigid.

11. The strap loop of claim 2 wherein one of said straps is wider than the other of said straps.

12. In a flexible stackable container capable of being lifted by mechanical means and defined by at least an encircling side wall portion and a bottom wall portion, the improvement comprising at least one self-raising strap loop connected to said container, said strap loop comprising a flexible strap member having end portions and a bight portion between said end portions, said end portions being secured to said container side wall portion, and resilient means associated with said bight portion over a substantial portion of the length thereof, whereby when said container is subjected to stacking forces the resilient means will flex to permit the strap loop to lie substantially flat on said container and, when such stacking forces are released, the resilient means will raise the loop to a position to accept the mechanical lifting means.

13. The improvement of claim 12 wherein said container has a generally rectangular configuration with four side wall portions, there being a strap loop for each corner of the container, each strap loop including a pair of elongated flexible straps positioned in abutting face-to-face juxtaposition, connected at each end to a corresponding one of the side wall portions forming the corner, and said resilient means being an elongated resilient insert positioned between said straps over substantially the entire length of the bight portion, said straps being secured together adjacent the longitudinal edges of said insert.

14. The improvement of claim 12 wherein said container has a generally rectangular configuration with four side wall portions, there being a strap loop for each corner of the container, each strap loop including an elongated tubular sleeve, connected at each end to a corresponding one of the side wall portions forming the corner, and said resilient means being an elongated resilient insert positioned within said sleeve over substantially the entire length of the bight portion.

15. The improvement of claim 12 wherein said container has a generally rectangular configuration with four side wall portions, there being a strap loop for each corner of the container, each strap loop including an elongated strap having a generally C-shaped cross-section with a base portion and a pair of re-entrant flange portions, connected at each end to a corresponding one of the side wall portions forming the corner, and said resilient means being an elongated resilient insert positioned within said strap, affixed to said base portion and covered at least in part by said re-entrant flange portions over substantially the entire length of the bight portion.

16. The improvement of claim 12 wherein said container has a generally rectangular configuration with four side wall portions, there being a strap loop for each corner of the container, each strap loop including a woven strap having warp and weft portions, connected at each end to a corresponding one of the side wall portions forming the corner, and wherein the weft portions are formed of a flexible plastics material and the warp portions are formed of resilient metallic wires.

17. The improvement of claim 12 wherein said container has a generally circular configuration defined by said side wall portion, there being two strap loops provided for said container, the strap loops being spaced apart and being parallel to each other, each strap loop including a pair of elongated flexible straps positioned in abutting face-to-face juxtaposition, with each end portion thereof extending along the full height of the container side wall portion, and said resilient means being an elongated resilient insert positioned between said straps over substantially the entire length of the bight portion, said straps being secured together adjacent the longitudinal edges of said insert.

18. The improvement of claim 12 wherein said container has a generally circular configuration defined by said side wall portion, there being two strap loops provides for said container, the strap loops being spaced apart and being parallel to each other, each strap loop including an elongated tubular sleeve, with each end portion thereof extending along the full height of the container side wall portion, and said resilient means being an elongated resilient insert positioned within said sleeve over substantially the entire length of the bight portion.

19. The improvement of claim 12 wherein said container has a generally circular configuration defined by said side wall portion, there being two strap loops provided for said container, the strap loops being spaced apart and being parallel to each other, each strap loop including an enlogated strap having a generally C-shaped cross-section with a base portion and a pair of re-entrant flange portions, with each end portion extending along the full height of the container side wall portion, and said resilient means being an elongated resilient insert positioned within said strap over substantially the entire length of said bight portion, said insert being affixed to said base portion and being covered at least in part by said re-entrant flange portions.

20. The improvement of claim 12 wherein said container has a generally circular configuration defined by said side wall portion, there being two strap loops provided for said container, the strap loops being spaced apart and being parallel to each other, each strap loop including a woven strap having warp and weft portions, with each end portion extending along the full height of said container side wall portion, said weft portions being formed of a flexible plastics material, and wherein said resilient means comprises the warp portions, formed of resilient metallic wires.

21. The improvement of claim 12 wherein said container has a generally circular configuration defined by said side wall portion, there being three strap loops provided for said container, equiangularly spaced apart about said side wall portion with the bight portion of each strap loop crossing the center of the container whereby the three bight loops cross at the center of the container, each strap loop including a pair of elongated flexible straps positioned in abutting face-to-face juxtaposition, with each end portion thereof extending along the full height of the container side wall portion, and said resilient means being an elongated resilient insert positioned between said straps over substantially the entire length of the bight portion, said straps being secured together adjacent the longitudinal edges of said insert.

22. The improvement of claim 12 wherein said container has a generally circular configuration defined by said side wall portion, there being three strap loops provided for said container, equiangularly spaced apart about said side wall portion with the bight portion of each strap loop crossing the center of the container whereby the three bight loops cross at the center of the container, each strap loop including an elongated tubular sleeve, with each end portion thereof extending along the full height of the container side wall portion, and said resilient means being an elongated resilient insert positioned within said sleeve over substantially the entire length of the bight portion.

23. The improvement of claim 22 wherein said container has a generally circular configuration defined by said side wall portion, there being three strap loops provided for said container, equiangularly spaced apart about said side wall portion with the bight portion of each strap loop crossing the center of the container whereby the three bight loops cross at the center of the container, each strap loop including an elongated strap having a generally C-shaped cross-section with a base portion and a pair of re-entrant flange portions, with each end portion extending along the full height of the container side wall portion, and said resilient means being an elongated resilient insert positioned within said strap over substantially the entire length of said bight portion, said insert being affixed to said base portion and being covered at least in part by said re-entrant flange portions.

24. The improvement of claim 12 wherein said container has a generally circular configuration defined by said side wall portion, there being three strap loops provided for said container, equiangularly spaced apart about said side wall portion with the bight portion of each strap loop crossing the center of the container whereby the three bight loops cross at the center of the container, each strap loop including a woven strap having warp and weft portions, with each end portion extending along the full height of said container side wall portion, said weft portions being formed of a flexible plastics material, and wherein said resilient means comprises the warp portions, formed of resilient metallic wires.

25. The improvement of claim 13, 14 or 15 wherein said insert is generally flat over its length and is formed of a resilient plastics material.

26. The improvement of claim 17, 18 or 19 wherein said insert is generally flat over its length and is formed of a resilient plastics material.

27. The improvement of claim 21, 22 or 23 wherein said insert is generally flat over its length and is formed of a resilient plastics material.

28. The improvement of claim 13, 14 or 15 wherein said insert is generally flat over its length and is formed of a resilient metallic material.

29. The improvement of claim 17, 18 or 19 wherein said insert is generally flat over its length and is formed of a resilient metallic material.

30. The improvement of claim 21, 22 or 23 wherein said insert is generally flat over its length and is formed of a resilient metallic material.

31. The improvement of claim 13, 14 or 15 wherein said insert is in the form of a plurality of resilient metallic wires.

32. The improvement of claim 17, 18 or 19 wherein said insert is in the form of a plurality of resilient metallic wires.

33. The improvement of claim 21, 22 or 23 wherein said insert is in the form of a plurality of resilient metallic wires.

34. In a flexible stackable container capable of being lifted by mechanical means, and having a generally rectangular configuration defined by two pairs of opposed side wall portions and a bottom wall, the improvement comprising a self-raising strap loop extending along each of two of said opposed wall portions adjacent the upper margin of said container, each loop comprising an extension of the corresponding wall portion with the extension being looped back and connected to the corresponding wall portion to define a bight portion, and, adjacent each end of each elongated strap loop, a resilient insert secured to the bight portion of the loop over a substantial portion of the length of the bight portion, whereby when said container is subjected to stacking forces the resilient inserts will flex to permit the strap loops to lie substantially flat on said container and, when such stacking forces are released, the resilient inserts will raise the loops to a position to accept the mechanical lifting means.

35. The improvement of claim 34 wherein each of said resilient inserts is secured to the material of the corresponding wall portion and extension prior to the formation of the loop therein.

36. The improvement of claim 35 wherein each of said resilient inserts is covered by a strip of flexible material which is secured to the material of the corresponding wall portion and extension.

37. The improvement of claim 34, 35 or 36 wherein said resilient insert is an elongated strip of a resilient plastics material.

38. The improvement of claim 34, 35 or 36 wherein said resilient insert is an elongated strip of resilient metallic material.

* * * * *